United States Patent [19]

Rodriguez et al.

[11] 4,005,024

[45] Jan. 25, 1977

[54] RINSE AID COMPOSITION CONTAINING AN ORGANOSILANE

[75] Inventors: Pedro A. Rodriguez, Forest Park; David C. Heckert, Oxford; David M. Watt, Jr., Cincinnati, all of Ohio

[73] Assignee: The Procter & Gamble Company, Cincinnati, Ohio

[22] Filed: Apr. 22, 1975

[21] Appl. No.: 570,939

[52] U.S. Cl. ..... 252/89 R; 252/94; 252/DIG. 15; 252/DIG. 17; 260/448.8 R; 260/448.2 N; 260/448.2 E; 260/448.2 Q

[51] Int. Cl.[2] ..... C11D 9/36

[58] Field of Search .... 252/547, DIG. 17, DIG. 15, 252/89; 260/448.8 R, 448.2 N, 448.2 E, 448.2 Q; 257/94

[56] References Cited

UNITED STATES PATENTS

| | | | |
|---|---|---|---|
| 2,955,127 | 10/1960 | Pike | 260/448.2 Q |
| 3,389,160 | 6/1968 | Reid | 260/448.2 N |
| 3,557,178 | 1/1971 | Gölitz | 260/448.2 N |
| 3,624,120 | 11/1971 | Yetter | 260/448.2 E |
| 3,658,867 | 4/1972 | Prokai | 260/448.2 N |

FOREIGN PATENTS OR APPLICATIONS

| | | | |
|---|---|---|---|
| 882,053 | 10/1957 | United Kingdom | 260/448.2 N |
| 686,068 | 4/1959 | United Kingdom | 260/448.2 N |

*Primary Examiner*—Mayer Weinblatt
*Attorney, Agent, or Firm*—Charles R. Wilson; Robert B. Aylor; Thomas H. O'Flaherty

[57] ABSTRACT

A rinse aid composition containing an organosilane and a low molecular weight monofunctional organic acid is capable of imparting soil release benefits to cooking utensils and tableware rinsed therewith. Food soils adhere to such surfaces less strongly, thereby making them easier to clean. The inclusion of the monofunctional organic acid insures that objectionable spotting or filming does not form on the rinsed objects.

23 Claims, No Drawings

RINSE AID COMPOSITION CONTAINING AN ORGANOSILANE

BACKGROUND OF THE INVENTION

This invention relates to a rinse aid composition containing an organosilane compound and a monofunctional organic acid. The rinse aid compositions of this invention are intended for use in both commercial and home automatic dishwashing machines.

Cooking utensils and tableware which are cleaned in automatic dishwashing machines pass through various washing cycles or, as is encountered in a commercial type automatic dishwashing machine, stages of the machine. The cycles or stages usually include a prerinse of warm water, followed by one or more spray washings of an aqueous solution of a detergent composition. A final step in each of the types of machines includes a water rinse to wash away residual detergent composition and loosened soil. Optionally, a separate dispenser is provided in the final rinse cycle or stage to deliver a rinse aid composition to the rinse water. This rinse aid composition contains a nonionic detergent to promote wetting and to produce a sheet flow, thereby reducing water spotting. Additionally the rinse aid composition increases the run-off speed of the water and reduces the drying time.

In commonly assigned copending patent application entitled "Organosilane-Containing Detergent Composition" by David C. Heckert and David M. Watt, Jr. U.S. Ser. No. 570,534, filed Apr. 22, 1975, there is disclosed detergent compositions which contain a water-soluble nonionic detergent and an organosilane compound. Rinse aid compositions are encompassed by this patent application. The organosilane compound is included in the composition for the purpose of imparting soil release benefits to surfaces contacted with the composition. That is, surfaces which are washed with the detergent composition containing the organosilane compound have deposited on them a polymerized film of the organosilane compound. As a result of this film, soil adheres to such surfaces less tenaciously thereby making them easier to clean in subsequent washes.

It has now been found that a detergent composition containing an organosilane compound intended for use as a rinse aid composition can be further improved by having included therein a monofunctional organic acid.

It is an object of this invention to provide a rinse aid composition which is able to impart soil release properties to surfaces contacted therewith.

It is another object of this invention to provide rinse aid compositions which possess the ability to impart soil release benefits to surfaces contacted therewith and which leave the surfaces substantially free of spots.

These and other objects will become apparent from the description to follow.

As used herein, all percentages and ratios are by weight unless otherwise stated.

SUMMARY OF THE INVENTION

A rinse aid composition capable of imparting soil release properties to cooking utensils and tableware washed therewith consisting essentially of:

a. from 0.1% to 50% of an organosilane having the formula:

$$(R_1O)_{3-a}-\overset{(R_2)_a}{\overset{|}{Si}}-(CHR_3)_b-[O-CH_2-CHOH-CH_2]_c-\overset{R_4}{\overset{|}{\underset{R_4}{\underset{|}{Y^+}}}}-R_5X^-$$

or is a siloxane oligomer thereof wherein $R_1$ is an alkyl group containing 1 to 4 carbon atoms, $$(CH_3)_3Si \text{ or } Z(OC_xH_{2x})_m$$

where $x$ is 2 to 4, $m$ is 1 to 20, and Z is hydrogen, an alkyl group containing 1 to 18 carbons or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an an alkyl, aryl or arylalkyl group containing 1 to 22 carbon atoms; X is halide; and Y is nitrogen, sulfur or phosphorus;

b. from 5% to 98.9% of a water-soluble organic nonionic detergent; and c. from 1% to 40% of a monofunctional organic acid containing 1 to 6 carbon atoms.

DETAILED DESCRIPTION OF THE INVENTION

The rinse aid compositions of this invention include an organosilane compound, a water-soluble organic nonionic detergent and a monofunctional organic acid. Each of the individual components will be described in more detail in the succeeding paragraphs. The rinse aid compositions provide a soil release benefit to all manner of cooking utensils and tableware rinsed therewith. As used herein, "cooking utensils and tableware" is used to describe metallic pots, pans, skillets and flatware and vitreous items such as china, glasses, and ceramic ware.

The organosilane has the following formula $$(R_1O)_{3-a}-\overset{(R_2)_a}{\overset{|}{Si}}-(CHR_3)_b-[O-CH_2-CHOH-CH_2]_c-\overset{R_4}{\overset{|}{\underset{R_4}{\underset{|}{Y^+}}}}-R_5X^-$$

or is a siloxane oligomer thereof wherein $R_1$ is an alkyl group containing 1 to 4 carbon atoms, $$(CH_3)_3Si \text{ or } Z(OC_xH_{2x})_m$$

where $x$ is 2 to 4, $m$ is 1 to 20, and Z is hydrogen, an alkyl group containing 1 to 18 carbon atoms or an acyl group containing 1 to 4 carbon atoms; $R_2$ is an alkyl group contaning 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an alkyl, aryl or arylalkyl group containing 1 to 22 carbon atoms; X is halide; and Y is nitrogen, sulfur or phosphorus. Preferably X is chloride or bromide and $b$ is 1.

It should be understood that the $R_4$ in the above formula and the formulae to follow may be the same or different. It should further be understood that when Y is S, there will be only one $R_4$ substituent. Also, when one $R_4$ is oxygen or, under acidic conditions, the anion of a carboxylic acid substituted alkyl, the counter ion $X^-$ is not extant. The 1 to 4 carbon atoms in the carboxy-substituted alkyl group is inclusive of the carboxyl group. The aryl or arylalkyl groups of $R_4$ and $R_5$ contain 6 to 12 carbon atoms and 6 to 22 carbon atoms, respectively.

Classes of organosilane compounds and their preparation which fit the above description follow.

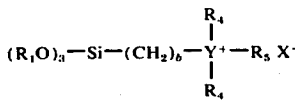

I.

wherein $R_1$ is a $C_{1-4}$ alkyl group, $b$ is from 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{4-22}$ alkyl, aryl or arylalkyl group, X is a halide, and Y is N, S or P.

When $b$ is 3 and $R_4$ is a $C_{1-12}$ alkyl, aryl or arylalkyl group, the class of compounds represented by Formula I is prepared by the following route:

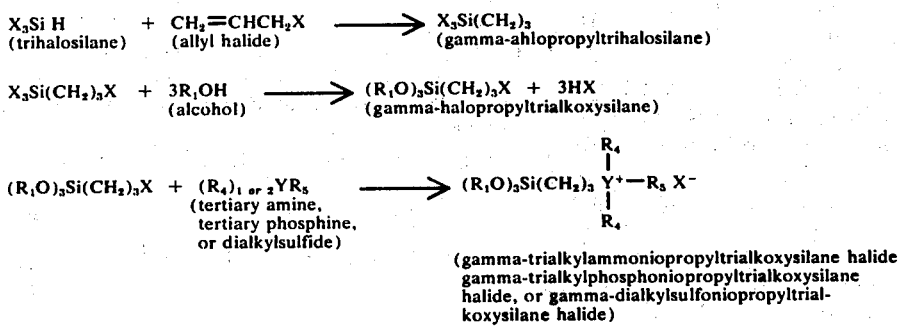

The trihalosilane (where the halogen is chlorine or bromine) is reacted with the allyl chloride at about 100° C. for from 4 to 10 hours in the presence of a catalyst, e.g., chloroplatinic acid or platinum. The resultant gamma-halopropyltrihalosilane is reacted with a lower alcohol to produce the gamma-halopropyltrialkoxysilane. At least three equivalents of alcohol per equivalent of halopropyltrihalosilane are added slowly to the silane. The gamma-halopropyltrihalosilane may be dissolved in an inert solvent, preferably hexane or pentane. (See W. Noll, "Chemistry and Technology of Silanes", Academic Press, New York, 1968, page 81 for the alcoholysis of halosilanes.) One equivalent of the gamma-halopropyltrialkoxysilane is reacted with one equivalent of the tertiary amine, tertiary phosphine, or dialkylsulfide to produce the organosilane. An inert solvent, preferably of high dielectric constant, may be used. The reaction is carried out at temperatures of from 40° C. to 120° C. and a time of 2 to 10 hours for the reaction of the bromopropyltrialkoxysilane and 120° C. to 150° C. for 2 to 20 hours for the reaction of the chloropropyltrialkoxysilane.

The compounds of Formula I when at least one $R_4$ is a carboxy-substituted $C_{1-4}$ alkyl group are prepared in the same manner except for the last reaction step. Here, a tertiary amine, tertiary phosphine or dialkylsulfide having a carboxy-containing alkyl group(s) is reacted with the alpha, beta or gamma-haloalkyltrialkoxysilane at 50° C. to 200° C. for 2 hours to 20 hours. Such carboxy-substituted tertiary amines, tertiary phosphines, and dialkylsulfides are produced by reacting $$R_4YHR_5 \text{ or } HYR_5$$

(where Y is sulfur) with $$X(CH_2)_{1-4}COOH$$

in the presence of base at elevated temperatures, e.g. 50° C. to 150° C.

The compounds of Formula I when at least one $R_4$ is $$(C_xH_{2x}O)_mZ$$

with $x$, $m$ and Z as defined above are produced in the manner given above except for the last reaction step. Thus, alpha-beta- and gamma-haloalkyltrialkoxysilane is reacted with a tertiary amine, tertiary phosphine, or dialkylsulfide where at least one substituent is $$(C_xH_{2x}O)_mZ$$

The reaction takes place at a temperature of 50° C. to 200° C. and a time of from 2 to 10 hours.

Compounds of Formula I when one $R_4$ is oxygen are prepared by following the reactions outlined above up to the last reaction step. At this point, a dialkyl amine, dialkyl phosphine or alkylthiol is reacted with the halosilane at 50° C. to 200° C. for from 4 to 10 hours and then with base to produce an intermediate tertiary amine, phosphine, or dialkyl sulfide. These intermediates are then reacted with $H_2O_2$ at 20° C. to 100° C. or preferably $O_3$ in an inert solvent at −80° C. to 20° C. to yield the organosilane.

When $b$ is 2 in Formula I, a trihalovinylsilane of formula $$X_3SiCH{=}CH_2$$

(which is commercially available) is reacted with hydrogen bromide in the presence of peroxide or light to produce a beta-haloethyltrihalosilane. This compound is reacted with an alcohol and thereafter with an appropriate amine, phosphine, or sulfide in the manner discussed above for the preparation of the compounds of Formula I when *b* is 3.

When *b* is 1 in Formula I, the starting reactant is a commercially available trihalomethylsilane of formula $X_3SiCH_3$.

This silane is reacted with chlorine or, preferably a half mole of bromine and a half mole of chlorine in the presence of light (such as provided by an ordinary tungsten or fluorescent lamp). The resultant alpha-halomethyltrihalosilane is reacted with an alcohol and thereafter an appropriate amine, phosphine or sulfide in the manner discussed above with the compounds of Formula I when b is 3.

Examples of compounds illustrative of compounds of Formula I follow:

$(CH_3O)_3SiCH_2N^+(CH_3)_2C_{16}H_{33}$ $Cl^-$
$(C_2H_5O)_3SiCH_2N^+(CH_3)_2C_6H_5$ $Cl^-$
$(C_2H_5O)_3Si(CH_2)_3N^+(C_2H_5)_2C_{10}H_{21}$ $Br^-$
$(C_3H_7O)_3SiCH_2N^+(C_3H_7)_2C_6H_4CH_3$ $Br^-$
$(C_4H_9O)_3Si(CH_2)_2N^+(C_2H_5)(CH_2C_6H_5)_2$ $Cl^-$
$(CH_3O)_3SiCH_2P^+(C_2H_5)_2C_{12}H_{25}$ $Cl^-$
$(C_2H_5O)_3Si(CH_2)_3P^+(C_4H_9)_2C_6H_5$ $Cl^-$
$(C_3H_7O)_3Si(CH_2)_2S^+(CH_3)C_6H_5$ $Cl^-$
$(CH_3O)_3SiCH_2CH_2S^+(C_2H_5)C_{16}H_{33}$ $Br^-$
$(CH_3O)_3SiCH_2N^+(C_2H_4COOH)_2C_{10}H_{21}$ $Br^-$
$(C_2H_5O)_3Si(CH_2)_3N^+(CH_2COOH)(CH_3)C_{12}H_{25}$ $Cl^-$
$(C_2H_5O)_3Si(CH_2)_2P^+(C_3H_6COOH)(C_2H_5)C_{10}H_{21}$ $Cl^-$
$(C_4H_9O)_3SiCH_2S^+(C_3H_6COOH)C_6H_{13}$ $Br^-$
$(CH_3O)_3SiCH_2N^+(C_2H_4OH)_2C_{18}H_{37}$ $Cl^-$
$(C_4H_9O)_3Si(CH_2)_3P^+(C_3H_6OH)_2C_6H_4CH_3$ $Cl^-$
$(C_2H_5O)_3SiCH_2S^+(C_3H_6OH)C_{14}H_{29}$ $Cl^-$
$(CH_3O)_3SiCH_2N^+(O)^-(CH_3)C_{14}H_{29}$
$(C_2H_5O)_3Si(CH_2)_3P^+(O)^-(C_2H_5)C_{12}H_{25}$
$(C_2H_5O)_3Si(CH_2)_2S^+(O)^-C_{10}H_{21}$
$(CH_3O)_3SiCH_2N^+[(C_2H_4O)_3H](CH_3)C_8H_{17}$ $Cl^-$
$(CH_3O)_3Si(CH_2)_2N^+[(C_4H_8O)_{15}CH_3](CH_3)C_6H_{13}$
$(C_2H_5O)_3Si(CH_2)_3N^+[(C_2H_4O)_6H]_2C_{10}H_{21}$ $Cl^-$
$(CH_3O)_3SiCH_2N^+[(C_2H_4O)_3COCH_3]_2C_8H_{17}$ $Cl^-$
$(C_3H_7O)_3SiCH_2P^+[(C_3H_6O)_{12}H]_2CH_2C_6H_5$ $Cl^-$
$(C_4H_9O)_3Si(CH_2)_3P^+[(C_2H_4O)_4C_4H_9]CH_3C_4H_9$ $Br^-$
$(CH_3O)_3Si(CH_2)_2P^+[(C_2H_4O)_5COC_2H_5]_2C_4H_9$ $Br^-$
$(CH_3O)_3SiCH_2S^+[(C_2H_4O)_5H]C_{10}H_{21}$ $Cl^-$
$(C_2H_5O)_3Si(CH_2)_2S^+[(C_3H_6O)_8C_3H_7]C_4H_9$ $Br^-$
$(CH_3O)_3Si(CH_2)_3S^+[(C_2H_4O)_{12}COC_4H_9]C_{12}H_{25}$ $Cl^-$

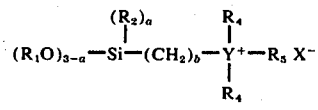

II.

where $R_1$ is a $C_{1-4}$ alkyl group, $R_2$ is a $C_{1-18}$ alkyl group *a* is 1 or 2, *b* is 1–3, $R_4$ is a $C_{1-12}$ alkyl, aryl or arylalkyl group, a carboxy-substituted $C_{1-4}$ alkyl group, $(C_xH_{2x}O)_mZ$ where *x* is 2–4, *m* is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

The compounds of Formula II are prepared in a manner similar to the preparation of the compounds of Formula I except for the fact that the starting reactants (when *b* is 1, 2, or 3) all have a $C_{1-18}$ alkyl group or two $C_{1-18}$ alkyl groups attached to the Si atom in place of a halogen atom(s). The starting reactant is commercially available when $R_2$ is $CH_3$. When $R_2$ is $C_2H_5$ or greater, the compound is prepared by reacting a silane with an appropriate olefin. Thus, $X_{3-a}SiH_{1+a}$ is reacted with a $C_2$ to $C_{18}$ olefin to obtain the desired starting reactant. The remaining reaction steps and conditions for producing the desired organosilane of Formula II are essentially the same as for producing the compounds of Formula I.

Examples of compounds of Formula II are:

$(CH_3O)_2CH_3SiCH_2N^+(CH_3)_2C_{12}H_{25}$ $Cl^-$
$(C_2H_5O)_2C_6H_{13}Si(CH_2)_2N^+(CH_3)_2C_{18}H_{37}$ $Cl^-$
$(C_3H_7O)(C_3H_7)_2Si(CH_2)_3N^+(C_2H_5)_2C_{10}H_{21}$ $Cl^-$
$(CH_3O)(CH_3)_2SiCH_2P^+(CH_3)_2C_{10}H_{21}$ $Cl^-$
$(C_3H_7O)_2C_{10}H_{21}Si(CH_2)_2S^+(C_4H_9)C_6H_{12}C_6H_5$ $Cl^-$
$(CH_3O)_2C_{16}H_{33}Si(CH_2)_3N^+(C_2H_4COOH)(CH_3)C_4H_9$ $Cl^-$
$(C_2H_5O)(CH_3)_2Si(CH_2)_2P^+(CH_2COOH)_2C_{10}H_{21}$ $Cl^-$
$(C_3H_7O)_2CH_3SiCH_2S^+(C_3H_6COOH)C_6H_{13}$ $Cl^-$
$(CH_3O)_2CH_3SiCH_2N^+(C_2H_4OH)_2C_{18}H_{37}$ $Cl^-$
$(C_3H_7O)(CH_3)_2SiCH_2P^+(C_3H_6OH)(C_4H_9)_2$ $Br^-$
$(C_4H_9O)_2CH_3Si(CH_2)_3S^+(C_3H_6OH)CH_3$ $Br^-$
$(CH_3O)_2CH_3SiCH_2N^+(O)^-(CH_3)C_{16}H_{33}$
$(CH_3O)_2C_{14}H_{29}Si(CH_2)_2P^+(O)^-(C_4H_9)_2$
$(C_4H_9O)(CH_3)_2Si(CH_2)_3S^+(O)^-C_{14}H_{29}$
$(CH_3O)_2CH_3SiCH_2N^+[(C_3H_6O)_{20}H]_2C_6H_5$ $Cl^-$
$(CH_3O)_2C_2H_5Si(CH_2)_2N^+[(C_4H_8O)_6C_2H_5]_2CH_3$ $Cl^-$
$(C_2H_5O)(CH_3)_2SiCH_2P^+[(C_2H_4O)_2H](C_6H_5)_2$ $Cl^-$
$(C_2H_5O)_2C_8H_{17}Si(CH_2)_3P^+[(C_2H_4O)_4C_6H_{13}]_2C_4H_9$ $Cl^-$
$(CH_3O)_2CH_3SiCH_2P^+[(C_2H_4O)_6COCH_3]_2C_8H_{17}$ $Cl^-$
$(CH_3O)_2CH_3SiCH_2S^+[(C_3H_6O)_2H]C_{14}H_{29}$ $Cl^-$
$(C_2H_5O)(C_2H_5)_2Si(CH_2)_3S^+[(C_2H_4O)_5CH_3]C_8H_{17}$ $Br^-$
$(C_2H_5O)_2C_{10}H_{21}SiCH_2N^+[(C_2H_4O)_2COC_2H_5](C_4H_9)_2$ $Cl^-$
$(CH_3O)_2C_4H_9Si(CH_2)_2S^+[(C_2H_4O)_2COCH_3]C_{12}H_{25}$ $Br^-$

Compounds of Formulas I and II when $R_4$ is an alkyl, aryl, arylalkyl group or oxygen are disclosed in British Patents 686,068 and 882,053 and U.S. Pat. Nos. 2,955,127, 3,557,178, 3,730,701, and 3,817,739. Compounds of Formulas I and II when $R_4$ is a carboxy-substituted alkyl group or $(C_xH_{2x}O)_mZ$ are disclosed in commonly assigned copending patent application "Organosilane Compounds" by Heckert and Watt, U.S. Ser. No. 570,532, filed Apr. 22, 1975. (The disclosure of this application is herein incorporated by reference.)

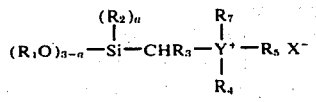

III.

wherein $R_1$ is a $C_{1-4}$ alkyl group, $a$ is 0 to 2, $R_2$ is a $C_{1-18}$ alkyl group, $R_3$ is a $C_{1-18}$ alkyl group, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

The compounds of Formula III when a is 0 and $R_4$ is an alkyl, aryl or arylalkyl group are prepared by the following route:

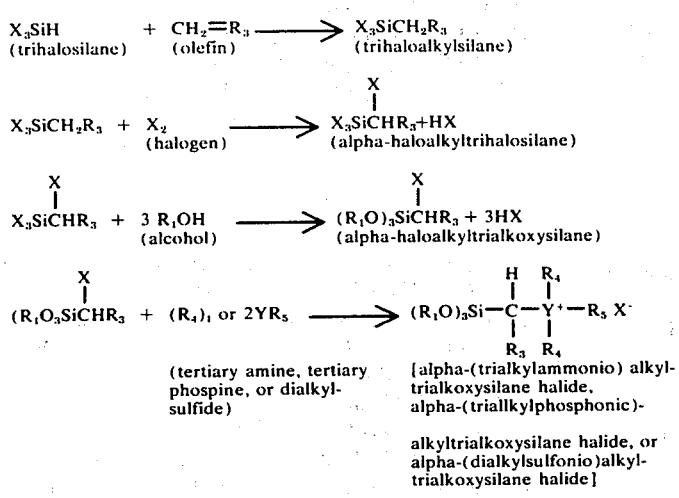

The trihalosilane is reacted with an olefin at 100° C. for 4 to 10 hours under a pressure of 50 to 300 psi. in the presence of a chloroplatinic acid or platinum catalyst to produce the trihaloalkylsilane. This reaction is reported by F. P. Mackay, O. W. Steward and P. G. Campbell in "Journal of the American Chemical Society", 79, 2764 (1957) and J. L. Speier, J. A. Webster and S. W. Barnes in Journal of the American Chemical Society, 79, 974 (1957). The trihaloalkylsilane is then halogenated in a known manner by treating it with halogen in the presence of light (such as that provided by ordinary tungsten or fluorescent lamps). Preferably, halogenation is carried out to only partial completion and a distillation is performed to recycle unreacted alkylsilane. The remaining reactions are the same as those described above in connection with the preparation of the compounds of Formula I.

When $a$ is 1 or 2, the preparation of the compounds is essentially the same except for the use of an alkyl substituted silane as the starting reactant.

When $R_4$ is a carboxy-substituted $C_{1-4}$ alkyl group, oxygen or $(C_xH_{2x}O)_mZ$ where $x$ is 2–4, $m$ is 1–20, and Z is hydrogen, a $C_{1-18}$ alkyl group, or a $C_{1-4}$ acyl group, an appropriate amine, phosphine, or sulfide is used in the reaction step as discussed above for the preparation of similarly substituted compounds of Formula I.

The compounds that follow are illustrative of compounds of Formula III.

$(C_2H_5O)_3SiCH(C_8H_{17})N^+(CH_3)_2C_{12}H_{25}$ $Cl^-$
$(CH_3O)_3SiCH(C_{18}H_{37})N^+(C_2H_4COOH)_2CH_3$ $Cl^-$
$(C_3H_7O)_2CH_3SiCH(C_{12}H_{25})N^+(C_2H_4OH)(CH_3)_2$ $Cl^-$
$(C_4H_9O)_3SiCH(C_3H_7)N^+[(C_2H_4O)_{10}H]_2C_6H_{13}$ $Br^-$
$(CH_3O)_3SiCH(C_{10}H_{21})N^+[(C_2H_4O)_2C_4H_9](CH_3)C_6H_5$ $Br^-$
$(CH_3O)_3SiCH(CH_3)N^+[(C_2H_4O)_3COC_2H_5](C_2H_5)_2$ $Br^-$
$(C_2H_5O)_2CH_3SiCH(C_8H_{17})N^+(O)^-(CH_3)_2$
$(CH_3O)_3SiCH(C_8H_{17})P^+(CH_3)_3$ $Cl^-$
$(CH_3O)_2CH_3SiCH(CH_3)P^+(C_3H_6COOH)_2C_{14}H_{28}C_6H_5$ $Cl^-$
$(C_2H_5O)_3SiCH(C_{10}H_{21})P^+(C_2H_4OH)C_4H_9$ $Cl^-$
$(CH_3O)_3SiCH(C_3H_7)P^+(O)^-(CH_3)C_{12}H_{25}$
$(CH_3O)_3SiCH(C_8H_{17})P^+[(C_2H_4O)_6H]_2CH_3$ $Cl^-$
$(C_2H_5O)_3SiCH(C_6H_{13})P^+[(C_3H_6O)_2C_{18}H_{37}](CH_3)_2$ $Cl^-$
$(CH_3O)_3SiCH(CH_3)S^+(CH_3)C_{16}H_{33}$ $Br^-$
$(C_2H_5O)_2CH_3SiCH(C_{12}H_{25})S^+(C_2H_4COOH)CH_3$ $Cl^-$
$(CH_3O)_2C_{16}H_{33}SiCH(C_2H_5)S^+(C_2H_4OH)C_2H_5$ $Cl^-$
$(CH_3O)_3SiCH(C_{10}H_{21})S^+(O)^-C_5H_{11}$
$(C_2H_5O)_3SiCH(C_4H_9)S^+[(C_3H_6O)_{10}H]C_6H_5$ $Cl^-$
$(C_2H_5O)_3SiCH(CH_3)S^+[(C_2H_4O)_{20}C_2H_5]CH_3$ $Br^-$

Commonly assigned copending patent application "Organosilane Compounds" by Heckert and Watt U.S. Ser. No. 570,537, filed Apr. 22, 1975 discloses the preparation of these compounds. (The disclosure of this application is herein incorporated by reference).

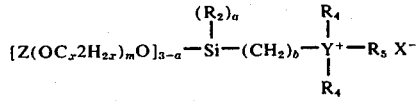

IV.

wherein Z is hydrogen, a $C_{1-18}$ alkyl group or a $C_{1-4}$ acyl group, $x$ is 2–4, $m$ is 1–20, $a$ is 0–2, $R_2$ is a $C_{1-18}$ alkyl group, $b$ is 1–3, $R_4$ is a $C_{1-12}$ alkyl, aryl or arylalkyl group, a carboxy-substituted $C_{1-4}$ alkyl group, $(C_xH_{2x}O)_mZ$ where $x$, $m$ and Z are as defined above, or oxygen provided only one $R_4$ is oxygen, $R_5$ is a $C_{1-22}$ alkyl, aryl or arylalkyl group, X is a halide, and Y is N, S or P.

The compounds with Formula IV are prepared in substantially the same manner as those of Formula II with the exception that $R_1OH$ is $$Z(OC_xH_{2x})_mOH$$

or alternatively the compounds of Formula II are heated in the presence of $$Z(OC_xH_{2x})_mOH$$

under conditions such that $R_1OH$ is removed from the system.

Exemplary compounds of Formula IV are as follows:

$[CH_3(OC_2H_4)O]_3SiCH_2N^+(CH_3)_2C_{14}H_{29}$ $Cl^-$ $[CH_3(OC_2H_4)_5O]_2CH_3Si(CH_2)_3N^+(CH_2COOH)_2C_{10}H_{21}$ $Cl^-$ $[H(OC_3H_6)_3O]_3SiCH_2N^+(C_2H_4OH)(CH_3)(C_{12}H_{25})$ $Cl^-$ $[H(OC_2H_4)_{18}O]_3Si(CH_2)_2N^+(O)^-(CH_3)C_{18}H_{37}$ $[CH_3CO(OC_2H_4)_{10}O]_3SiCH_2N^+[(C_2H_4O)_{14}H]_2C_8H_{16}C_6H_5$ $Cl^-$ $[C_{16}H_{33}(OC_2H_4)_8O]_2C_6H_{13}SiCH_2N^+[(C_3H_6O)CH_3](CH_3)_2$ $Br^-$ $[H(OC_4H_8)_8O]_3SiCH_2N^+[(C_2H_4O)_4COCH_3]_2CH_3$ $Cl^-$ $[C_6H_{13}(OC_2H_4)_2O]_3Si(CH_2)_2P^+(CH_3)_2C_{10}H_{21}$ $Br^-$ $[CH_3(OC_3H_6)_{14}O]_3SiCH_2P^+(C_2H_4COOH)(C_6H_{13})_2$ $Cl^-$ $[C_2H_5(OC_2H_4)O]_2CH_3Si(CH_2)_2P^+(C_4H_8OH)(CH_3)C_6H_5$ $Cl^-$ $[CH_3(OC_2H_4)_8O]_3SiCH_2P^+(O)^-(CH_3)C_8H_{17}$ $[C_2H_5CO(OC_2H_4)_2O]_3Si(CH_2)_3P^+[C_2H_4O)_8H]_2C_6H_{13}$ $Cl^-$ $[CH_3(OC_4H_8)O]_3SiCH_2P^+[(C_3H_6O)_2C_7H_{15}](C_4H_9)_2$ $Br^-$ $[C_2H_5CO(OC_2H_4)O]_3SiCH_2S^+(CH_3)C_{18}H_{37}$ $Cl^-$ $[H(OC_2H_4)_4O]_3Si(CH_2)_2S^+(C_2H_4COOH)C_{12}H_{25}$ $Br^-$ $[CH_3(OC_2H_4)_{20}O]_3Si(CH_2)_3S^+(C_3H_6OH)C_{16}H_{33}$ $Br^-$ $[H(OC_3H_6)_{12}O]_3Si(CH_2)_2S^+(O)^-C_5H_{11}$ $[C_{12}H_{25}(OC_2H_4)_4O]_3SiCH_2S^+[(C_2H_4O)_{20}H]CH_3$ $Br^-$ $[H(OC_2H_4)_{12}O]_3Si(CH_2)_3S^+[(C_2H_4O)C_{14}H_{29}]C_6H_4CH_3$ $Cl^-$

Commonly assigned copending patent application "Organosilane Compounds" by Heckert and Watt U.S. Ser. No. 570,539, filed Apr. 22, 1975, discloses the preparation of these compounds. (The disclosure of this application is herein incorporated by reference.)

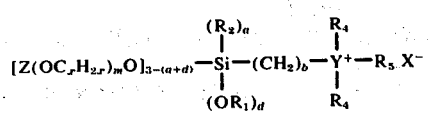

V.

wherein Z is hydrogen, a $C_{1-18}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided a+d does not exceed 2, $b$ is 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$, $m$ and Z are as defined above, or oxygen provided only one $R_4$ is oxygen, $R_5$ is a $C_{1-22}$ alkyl, aryl or aryl alkyl group, X is halide, and Y is N, S or P.

The compounds of Formula V are formed in substantially the same manner as those of formula II except that a mixture of $R_1OH$ and $$Z(OC_xH_{2x})_mOH$$

in the desired ratio is used in place of $R_1OH$ or, alternatively, the compounds of Formula II are heated with less than $3-a$ equivalents of $$Z(OC_xH_{2x})_mOH$$

under conditions such that $R_1OH$ is removed from the system.

Examples of illustrative compounds follow:

$[H(OC_2H_4)_5O](CH_3)(C_2H_5O)SiCH_2N^+(CH_3)_2C_{12}H_{25}$ $Cl^-$ $[C_{12}H_{25}(OC_2H_4)_3O](CH_3O)_2Si(CH_2)_3N^+(C_2H_5)_2C_6H_5$ $Cl^-$ $[H(OC_4H_8)_6O](C_2H_5O)_2Si(CH_2)_3N^+[(C_2H_4O)_{10}H]_2C_{18}H_{37}$ $Br^-$ $[CH_3CO(OC_2H_4)_3O]_2(C_2H_5O)Si(CH_2)_2N^+[(C_2H_4O)C_2H_5](C_6H_5CH_3)_2$ $Cl^-$ $[H(OC_2H_4)_{12}O](C_4H_8O)_2SiCH_2N^+[(C_2H_4O)_4COCH_3]_2C_{14}H_{29}$ $Cl^-$ $[C_{16}H_{33}(OC_2H_4)_3O](C_2H_5)(CH_3O)SiCH_2N^+(O)^-(CH_3)C_6H_{13}$ $[H(OC_3H_6)_{12}O](C_2H_5O)_2SiCH_2N^+(C_2H_5COOH)(CH_3)C_{10}H_{21}$ $Cl^-$ $[C_2H_5(OC_2H_4)_{14}O]_2(C_4H_9O)Si(CH_2)_3N^+(C_4H_8OH)(CH_3)C_{14}H_{29}$ $Cl^-$ $[H(OC_2H_4)_{16}O]_2(CH_3O)SiCH_2P^+(CH_3)_2C_6H_4C_2H_5$ $Cl^-$ $[C_3H_7(OC_2H_4)_6O](C_2H_5)(CH_3O)SiCH_2P^+[(C_2H_4O)_8H]_2C_8H_{17}$ $Br^-$ $[CH_3CO(OC_2H_4)_2O]_2(CH_3O)Si(CH_2)_2P^+[(C_3H_6O)_3C_2H_5](C_4H_9)_2$ $Cl^-$ $[H(OC_4H_8)_2O](C_{12}H_{25})(CH_3O)SiCH_2P^+(O)^-(CH_3)C_6H_5{}_2$ $[C_{14}H_{29}(OC_2H_4)_6O](CH_3O)_2SiCH_2P^+(C_3H_6COOH)_2CH_3$ $Cl^-$ $[H(OC_2H_4)_8O]_2(C_4H_9O)SiCH_2P^+(C_3H_6OH)_2C_2H_5$ $Br^-$ $[H(OC_2H_4)_{10}O]_2(C_3H_7O)SiCH_2S^+(CH_3)C_6H_{12}C_6H_5$ $Cl^-$ $[H(OC_4H_8)_2O]_2(CH_3O)Si(CH_2)_3S^+[(C_2H_4O)_4H]CH_3$ $Br^-$ $[C_{12}H_{25}(OC_2H_4)_6O](CH_3)(CH_3O)SiCH_2S^+[(C_3H_6O)_8CH_3]C_3H_7$ $Cl^-$ $[CH_3CO(OC_2H_4)_3O](C_2H_5O)_2Si(CH_2)_2S^+(C_2H_4OH)C_{12}H_{25}$ $Cl^-$ $[CH_3(OC_3H_6)_{12}O](CH_3O)_2SiCH_2S^+(C_3H_6COOH)CH_2C_6H_5$ $Br^-$ $[H(C_2H_4O)_6O](C_{12}H_{25})(CH_3O)SiCH_2S^+(O)^-C_{14}H_{29}$

Commonly assigned copending patent application "Organosilane Compounds" by Heckert and Watt, U.S. Ser. No. 570,539, filed Apr. 22, 1975, discloses the preparation of these compounds. (The disclosure of this application is herein incorporated by reference.)

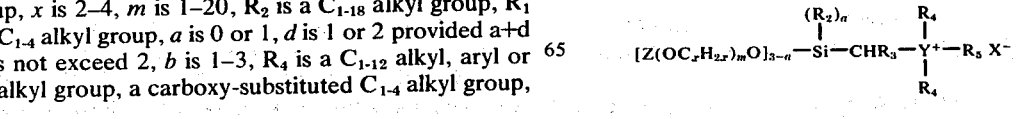

VI.

wherein Z is hydrogen, a $C_{1-18}$ alkyl group or a $C_{1-4}$ acyl group, $x$ is 2–4, $m$ is 1–20, $a$ is 0–2, $R_2$ is a $C_{1-18}$ alkyl group, $R_3$ is a $C_{1-18}$ alkyl group, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide and Y is N, S or P.

The compounds of Formula VI are formed in the same manner as those of Formula III with the exception that $$Z(OC_xH_{2x})_mOH$$

is used in place of $$R_1OH$$

during the alcoholysis of the halo-silane. Alternatively, preparation may be effected by the heating of compounds of Formula III with $$Z(OC_xH_{2x})_mOH$$

under conditions such that all of the $$R_1OH$$

is removed from the system. The following compounds illustrate the compounds of Formula VI.

$[CH_3(OC_2H_4)_3O]_3SiCH(CH_3)N^+(CH_3)_2C_{18}H_{37}$ $Cl^-$ $[C_2H_5(OC_2H_4)O]_2CH_3SiCH(C_2H_5)N^+(C_2H_4OH)_2C_{14}H_{29}$ $Cl^-$ $[H(OC_4H_8)_8O]_3SiCH(C_4H_9)N^+(C_2H_4COOH)(C_4H_9)CH_2C_6H_5$ $Cl^-$ $[CH_3CO(OC_2H_4)_2O]_3SiCH(C_2H_5)N^+(O)^-(CH_3)C_{10}H_{21}$ $[H(OC_3H_6)_6O]_3SiCH(C_{12}H_{25})N^+[(C_2H_4O)_{10}H]_2CH_3$ $Br^-$ $[C_{12}H_{25}(OC_2H_4)O]_3SiCH(C_3H_7)N^+[(C_4H_8O)_3C_5H_{10}](C_2H_5)_2$ $Cl^-$ $[C_{10}H_{21}(OC_2H_4)_4O]_3SiCH(C_2H_5)N^+[(C_2H_4O)_6COCH_3]_2CH_3$ $Cl^-$ $[H(OC_2H_4)_{16}O]_3SiCH(C_8H_{17})P^+(C_2H_5)_2C_6H_4C_4H_9$ $Cl^-$ $[CH_3(OC_2H_4)_{16}O]_2C_{12}H_{25}SiCH(CH_3)P^+(C_2H_4COOH)_2C_{10}H_{21}$ $Cl^-$ $[C_2H_5OC(OC_2H_4)_5O]_3SiCH(CH_3)P^+(C_2H_4OH)(CH_3)C_{12}H_{25}$ $Cl^-$ $[H(OC_2H_4)_2O]_3SiCH(C_{10}H_{25})P^+(O)^-(CH_3)C_{16}H_{33}$ $[H(OC_2H_4)_2O]_3SiCH(C_8H_{17})P^+[(C_2H_4O)_6H]_2C_4H_9$ $Br^-$ $[CH_3(OC_4H_8)_2O]_3SiCH(CH_3)P^+[(C_2H_4O)C_8H_{17}](CH_3)_2$ $Cl^-$ $[C_{10}H_{21}(OC_2H_4)_2O]_3SiCH(C_6H_{13})S^+(CH_3)C_{10}H_{21}$ $Cl^-$ $[H(OC_2H_4)_{14}O]_2CH_3SiCH(C_8H_{17})S^+(C_2H_4COOH)C_{18}H_{37}$ $Cl^-$ $[H(OC_3H_6)_4O]_3SiCH(C_{14}H_{29})S^+(C_4H_8OH)C_6H_5$ $Cl^-$ $[CH_3CO(OC_2H_4)_3O]_3SiCH(C_2H_5)S^+(O)^-C_{18}H_{37}$ $[C_{12}H_{25}(OC_2H_4)O]_3SiCH(C_3H_7)S^+[(C_3H_6O)H]C_6H_{13}$ $Cl^-$ $[H(OC_4H_8)_4O]_2CH_3SiCH(C_4H_9)S^+[C_2H_4O)_8C_3H_7]CH_3$ $Br^-$

Commonly assigned copending patent application "Organosilane Compounds" by Heckert and Watt, U.S. Ser. No. 570,537, filed Apr. 22, 1975, discloses the preparation of these compounds. (The disclosure of this application is herein incorporated by reference.)

$$[Z(OC_xH_{2x})_mO]_{3-(a+d)}-\underset{(OR_1)_d}{\overset{(R_2)_a}{Si}}-CHR_3-\underset{R_4}{\overset{R_4}{Y^+}}-R_5\ X^- \qquad \text{VII.}$$

wherein Z is hydrogen, a $C_{1-18}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided $a+d$ does not exceed 2, $R_3$ is a $C_{1-18}$ alkyl group, $R_4$ is a $C_{1-12}$ alkyl, aryl or arylalkyl group, a carboxy-substituted $C_{1-4}$ alkyl group, $(C_xH_{2x}O)_mZ$ where $x$, $m$ and Z are as defined above, or oxygen provided only one $R_4$ is oxygen, $R_5$ is a $C_{1-22}$ alkyl, aryl or arylalkyl group, X is halide and Y is N, S or P.

Compounds having Formula VII are prepared in substantially the same manner as those of Formula III except that a mixture of $$R_1OH$$

and $$Z(OC_xH_{2x})_mOH$$

in the desired ratio is used in place of $R_1OH$. Alternatively, the compounds of Formula III are heated together with less than 3-$a$ equivalents of $$Z(OC_xH_{2x})_mOH$$

under conditions such that $R_1OH$ is removed from the system.

The following compounds are illustrative of the compounds of Formula VII:

$[H(OC_2H_6)_6O](C_2H_5O)_2SiCHC_{12}H_{25}N^+[(C_2H_4O)_{10}H]_2C_{18}H_{37}$ $Br^-$ $[CH_3CO(OC_2H_4)_3O]_2(C_2H_5O)SiCHCH_3N^+[(C_2H_4O)C_2H_5]_2C_6H_5CH_3$ $Cl^-$ $[H(OC_2H_4)_{12}O](C_4H_8O)_2SiCHC_2H_5N^+[(C_2H_4O)_4COCH_3]_2C_{14}H_{29}$ $Cl^-$ $[C_{16}H_{33}(OC_2H_4)_3O](C_2H_5)(CH_3O)SiCHCH_3N^+(O)^-(CH_3)C_6H_{13}$ $[C_2H_5(OC_2H_4)_{14}O]_2(C_4H_9O)SiCHC_6H_{13}N^+(C_6H_{12}OH)(CH_3)C_{14}H_{29}$ $Cl^-$ $[H(OC_2H_4)_{16}O]_2(CH_3O)SiCHC_4H_9P^+(CH_3)_2C_{18}H_{37}$ $Cl^-$ $[CH_3CO(OC_2H_4)_2O]_2(CH_3O)SiCHC_{16}H_{33}P^+[(C_3H_7O)_3C_2H_5](C_4H_9)_2$ $Cl^-$ $[C_{14}H_{29}(OC_2H_4)_6O](CH_3O)_2SiCHCH_3P^+(C_3H_6COOH)_2CH_3$ $Cl^-$ $[H(OC_2H_4)_{10}O]_2(C_3H_7O)SiCHC_5H_{11}S^+(CH_3)C_{12}H_{25}$ $Cl^-$ $[H(OC_4H_8)_2O]_2(CH_3O)SiCHC_8H_{17}S^+CH_3C_6H_5$ $Br^-$

Commonly assigned copending patent application "Organosilane Compounds" by Heckert and Watt, U.S. Ser. No. 570,537, filed Apr. 22, 1975, discloses the preparation of the compounds. (The disclosure of this application is herein incorporated by reference.)

$$[(CH_3)_3-Si-O]_{3-a}-\overset{(R_2)_a}{\overset{|}{Si}}-(CH_2)_b-\underset{R_4}{\overset{R_4}{Y^+}}-R_5\ X^- \qquad \text{VIII.}$$

wherein $a$ is 0–2, $R_2$ is $C_{1-18}$ alkyl group, $b$ is 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

When $a$ is 0, a tris(trimethylsiloxy) silane is used as the starting reactant. Commercially available trihalosilanes and trimethylsilanes are used to produce the starting reactant. Subsequent reaction steps and conditions as discussed in the preparation of compounds of Formula I are used to produce the desired compound of Formula VI.

When $a$ is 1 or 2, a corresponding compound of Formula II is reacted with trimethylchlorosilane at an elevated temperature, e.g., 50° C. to 200° C. to obtain the desired organosilane.

Examples of compounds of Formula VIII are:

$[(CH_3)_3SiO]_3SiCH_2N^+(CH_3)_2C_{14}H_{29}$ $Cl^-$ $[(CH_3)_3SiO]_2CH_3Si(CH_2)_3N^+(CH_2COOH)_2C_6H_5$ $Cl^-$ $[(CH_3)_3SiO]_3SiCH_2N^+(C_2H_4OH)$ $(CH_3)$ $(C_{12}H_{25})$ $Cl^-$ $[(CH_3)_3SiO]_3Si(CH_2)_2N^+(O)^-(CH_3)C_8H_{17}$ $[(CH_3)_3SiO]_3SiCH_2N^+[(C_2H_4O)_{14}H]_2CH_3$ $Cl^-$ $[(CH_3)_3SiO]_2CH_3SiCH_2N^+[(C_3H_6O)CH_3](CH_3)_2$ $Br^-$ $[(CH_3)_3SiO]_3SiCH_2N^+[(C_2H_4O)_4COCH_3]_2CH_3$ $Cl^-$ $[(CH_3)_3SiO]_3Si(CH_2)_2P^+(CH_3)_2C_{10}H_{21}$ $Br^-$ $[(CH_3)_3SiO]_3SiCH_2P^+(C_2H_4COOH)$ $(C_6H_{13})_2$ $Cl^-$ $[(CH_3)_3SiO]_2CH_3Si(CH_2)_2P^+(C_4H_8OH)$ $(CH_3)C_{10}H_{21}$ $Cl^-$ $[(CH_3)_3SiO]_3SiCH_2P^+(O)^-(CH_3)C_6H_5$ $[(CH_3)_3SiO]_3Si(CH_2)_3P^+[(C_2H_4O)_8H]_2C_6H_{13}$ $Cl^-$ $[(CH_3)_3SiO]_3SiCH_2P^+[(C_3H_6O)_2C_7H_{15}]$ $(C_4H_9)_2$ $Br^-$ $[(CH_3)_3SiO]_3SiCH_2S^+(CH_3)C_{18}H_{37}$ $Cl^-$ $[(CH_3)_3SiO]_3Si(CH_2)_2S^+(C_2H_4COOH)C_{12}H_{25}$ $Br^-$ $[(CH_3)_3SiO]_3Si(CH_2)_3S^+(C_3H_6OH)C_6H_4CH_3$ $Br^-$ $[(CH_3)_3SiO]_3Si(CH_2)_2S^+(O)^-C_{14}H_{29}$ $[(CH_3)_3SiO]_3SiCH_2S^+[(C_2H_4O)_{20}H]CH_3$ $Br^-$ $[(CH_3)_3SiO]_3Si(CH_2)_3S^+[(C_2H_4O)C_{14}H_{29}]C_2H_5$ $Cl^-$

Commonly assigned copending patent application "Organosilane Compounds" by Heckert and Watt, U.S. Ser. No. 570,538, filed Apr. 22, 1975, discloses the preparation of the compounds when $R_4$ is a carboxy-substituted alkyl group or $$(C_xH_{2x}O)_mZ.$$

(The disclosure of this application is herein incorporated by reference.) U.S. Pat. Nos. 2,955,127, 3,624,120 and 3,658,867 discloses the compounds when $R_4$ is alkyl, aryl, arylalkyl or oxygen.

$$[(CH_3)_3-Si-O]_{3-a}-\overset{(R_2)_a}{\overset{|}{Si}}-CHR_3-\underset{R_4}{\overset{R_4}{Y^+}}-R_5\ X^- \qquad \text{IX.}$$

wherein $a$ is 0–2, $R_2$ is a $C_{1-18}$ alkyl group, $R_3$ is a $C_{1-18}$ alkyl group, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide and Y is N, S or P.

When $a$ is 0, the compounds of Formula IX are prepared following the description given for the preparation of the compounds of Formula III with the exception that a tris(trimethylsiloxy)silane is used as the starting reactant. When $a$ is 1 or 2, a corresponding compound of Formula III is reacted with a trimethylchlorosilane at about 50° C. to 200° C. to produce the desired organosilane.

Illustrative compounds of Formula IX follow:

$[(CH_3)_3SiO]_3SiCH(CH_3)N^+(CH_3)_2C_{18}H_{37}$ $Cl^-$ $[(CH_3)_3SiO]_2CH_3SiCH(C_2H_5)N^-(C_2H_4OH)_2C_6H_4CH_3$ $Cl^-$ $[(CH_3)_3SiO]_3SiCH(C_4H_9)N^+(C_3H_6COOH)$ $(C_4H_9)_2$ $Cl^-$ $[(CH_3)_3SiO]_3SiCH(C_2H_5)N^+(O)^-(CH_3)C_{10}H_{21}$ $[(CH_3)_3SiO]_3SiCH(C_{12}H_{25})N^+[(C_2H_4O)_{10}H]_2CH_3$ $Br^-$ $[(CH_3)_3SiO]_3SiCH(C_3H_7)N^+[(C_4H_8O)_3C_5H_{10}](C_2H_5)_2$ $Cl^-$ $[(CH_3)_3SiO]_3SiCH(C_2H_5)N^+[(C_2H_4O)_6COCH_3]_2CH_3$ $Cl^-$ $[(CH_3)_3SiO]_3SiCH(C_8H_{17})P^+(C_2H_5)_2C_8H_{17}$ $Cl^-$ $[(CH_3)_3SiO]_2C_2H_5SiCH(CH_3)P^+(C_3H_6COOH)_2C_{10}H_{21}$ $Cl^-$ $[(CH_3)_3SiO]_3SiCH(CH_3)P^+(C_2H_4OH)$ $(CH_3)C_{12}H_{25}$ $Cl^-$ $[(CH_3)_3SiO]_3SiCH(C_{10}H_{21})P^+(O)^-(CH_3)C_8H_{17}$ $[(CH_3)_3SiO]_3SiCH(C_8H_{17})P^+[(C_2H_4O)_6H]_2C_4H_9$ $Br^-$ $[(CH_3)_3SiO]_3SiCH(CH_3)P^+[(C_2H_4O)C_8H_{17}[_2C_6H_4C_2H_5$ $Cl^-$ $[(CH_3)_3SiO]_3SiCH(C_6H_{13})S^+(CH_3)C_{16}H_{33}$ $Cl^-$ $[(CH_3)_3SiO]_2CH_3SiCH(C_8H_{17})S^+(C_2H_4COOH)C_6H_5$ $Cl^-$ $[(CH_3)_3SiO]_3SiCH\ 14H_{29})S^+(C_4H_8OH)CH_3$ $Cl^-$ $[(CH_3)_3SiO]_3SiCH(C_2H_5)S^+(O)^-C_{18}H_{37}$ $[(CH_3)_3SiO]_3SiCH(C_3H_7)S^+[(C_3H_6O)H]C_{12}H_{25}$ $Cl^-$ $[(CH_3)_3SiO]_2C_{18}H_{37}SiCH(C_4H_9)S^+[(C_2H_4O)_8C_3H_7]CH_3$ $Br^-$

Commonly assigned copending patent application "Organosilane Compounds" by Heckert and Watt, U.S. Ser. No. 570,537, filed Apr. 22, 1975, discloses the preparation of these compounds. (The disclosure of this application is herein incorporated by reference.)

$$(R_1O)_{3-a}-\overset{(R_2)_a}{\overset{|}{Si}}-(CH_2)_b-O-CH_2-CHOH-CH_2-\underset{R_4}{\overset{R_4}{\underset{|}{\overset{|}{Y^+}}}}-R_5\ X^- \qquad \text{X.}$$

wherein $R_1$ is a $C_{1-4}$ alkyl group, $a$ is 0–2, $R_2$ is a $C_{1-18}$ alkyl group, $b$ is 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

The compounds of Formula X are prepared by initially reacting (when $a$ is 0 and $b$ is 3) thihalosilane with an alcohol ($R_1OH$) at 0° C. to 50° C. for 1 to 10 hours to produce a trialkoxysilane. This silane is then reacted with an allylglycidylether $$(CH_2{=}CHCH_2OCH_2\overset{O}{\overset{/\backslash}{CHCH_2}})$$

in the presence of 0.01% to 0.1% chloroplatinic acid or platinum at 100° C. for 2 to 10 hours. The resultant product $$[(R_1O)_3Si-(CH_2)_3OCH_2\overset{O}{\overset{/\backslash}{CHCH_2}}]$$

is reacted with a tertiary amine, tertiary phosphine, or dialkylsulfide in the presence of an acid in an inert solvent at 60° C. to 100° C. for 1 to 10 hours to produce the compound of Formula X.

When $a$ is 1 or 2, the preparation of the compounds is essentially the same except for the use of an alkyl substituted silane as the starting reactant.

When $b$ is 2 in Formula X, a trihalovinylsilane of formula $$X_3SiCH{=}CH_2$$

(which is commercially available) is reacted with hydrogen bromide in the presence of peroxide or light to produce a beta-haloethyltrihalosilane. This compound is reacted with an alcohol, an allylglycidylether, and finally with an appropriate amine, phosphine, or sulfide in the manner discussed above for the preparation of the compounds of Formula X when $b$ is 3.

When $b$ is 1 in Formula X, the starting reactant is a commercially available trihalomethylsilane of formula $$X_3SiCH_3.$$

This silane is reacted with chlorine or, preferably a half mole of bromine and a half mole of chlorine in the presence of light (such as provided by an ordinary tungsten or fluorescent lamp). The resultant alpha-halomethyltrihalosilane is reacted with an alcohol, an allylglycidylether, and finally an appropriate amine, phosphine, or sulfide in the manner discussed above with the compounds of Formula X when $b$ is 3.

The following compounds illustrate the compounds of Formula X.

$(CH_3O)_3Si(CH_2)_3OCH_2CHOHCH_2N^+(CH_3)_2C_{16}H_{33}$ $Cl^-$ $(CH_3O)_2C_{12}H_{25}SiCH_2OCH_2CHOHCH_2N^+(C_3H_6COOH)(C_4H_9)C_8H_{17}$ $Cl^-$ $(C_2H_5O)_3Si(CH_2)_2OCH_2CHOHCH_2N^+(C_2H_4OH)_2C_6H_5$ $Br^-$ $(CH_3O)_3Si(CH_2)_3OCH_2CHOHCH_2N^+(O)^-(CH_3)C_8H_{17}$ $(CH_3O)_3SiCH_2OCH_2CHOHCH_2N^+[(C_2H_4O)H]_2C_{14}H_{29}$ $Br^-$ $(CH_3O)_2C_2H_5SiCH_2OCH_2CHOHCH_2N^+[(C_3H_6O)_{12}C_2H_5](CH_3)_2$ $Cl^-$ $(C_4H_9O)_3SiCH_2OCH_2CHOHCH_2N^+[(C_2H_4O)_3COCH_3]_2CH_3$ $Br^-$ $(CH_3O)_3SiCH_2OCH_2CHOHCH_2P^+(C_4H_9)_2CH_2C_6H_5$ $Br^-$ $(C_4H_9O)_3SiCH_2OCH_2CHOHCH_2P^+(C_2H_4COOH)_2C_8H_{17}$ $Cl^-$ $(CH_3O)_3Si(CH_2)_2OCH_2CHOHCH_2P^+(C_2H_4OH)(C_2H_5)C_{10}H_{21}$ $Cl^-$ $(CH_3O)_3SiCH_2OCH_2CHOHCH_2P^+(O)^-(CH_3)C_{18}H_{37}$ $(CH_3O)_3SiCH_2OCH_2CHOHCH_2P^+[C_3H_6O)_{18}H]_2CH_3$ $Br^-$ $(C_2H_5O)(CH_3)_2SiCH_2OCH_2CHOHCH_2P^+[(C_2H_4O)CH_3]_2C_6H_{13}$ $(CH_3O)_3SiCH_2OCH_2CHOHCH_2S^+(CH_3)C_6H_4CH_3$ $Cl^-$ $(CH_3O)_2C_{16}H_{37}SiCH_2OCH_2CHOHCH_2S^+(C_2H_4COOH)C_8H_{17}$ $Cl^-$ $(CH_3O)_3Si(CH_2)_2OCH_2CHOHCH_2S^+(C_2H_4OH)C_6H_{13}$ $Cl^-$ $(C_2H_5O)_3SiCH_2OCH_2CHOHCH_2S^+(O)^-C_{10}H_{21}$ $(CH_3O)_3SiCH_2OCH_2CHOHCH_2S^+[(C_2H_4O)_{12}H]CH_3$ $Br^-$ $(C_2H_5O)_3SiCH_2OCH_2CHOHCH_2S^+[(C_2H_4O)_2C_8H_{17}]C_2H_5$ $Br^-$

Commonly assigned copending patent application "Organosilane Compounds" by Heckert and Watt, U.S. Ser. No. 570,531, filed Apr. 22, 1975, discloses the preparation of these compounds. (The disclosure of this application is herein incorporated by reference.)

$$[Z(OC_xH_{2x})_mO]_{3-a}-\overset{(R_2)_a}{\overset{|}{Si}}-(CH_2)_b-O-CH_2-CHOH-CH_2-\underset{R_4}{\overset{R_4}{\underset{|}{\overset{|}{Y^+}}}}-R_5\ X^- \qquad \text{XI.}$$

wherein Z is hydrogen, a $C_{1-18}$ alkyl group or a $C_{1-4}$ acyl group, $x$ is 2–4, $m$ is 1–20, $a$ is 0–2, $R_2$ is a $C_{1-18}$ alkyl group, $b$ is 1–3, $R_4$ is a $C_{1-12}$ alkyl, aryl, or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is a halide, and Y is N, S or P.

Compounds of Formula XI are prepared in a manner identical with that of Formula X except that $R_1OH$ is replaced by $$HO(C_xH_{2x}O)_mZ.$$

The following compounds are exemplary of Formula XI compounds.

$[H(OC_2H_4)_{20}O]_3SiCH_2OCH_2CHOHCH_2N^+(CH_3)_2C_{10}H_{21}$ $Cl^-$ $[CH_3(OC_3H_6)_{10}O]_2CH_3SiCH_2OCH_2CHOHCH_2N^+(C_2H_4COOH)(C_4H_9)_2$ $Cl^-$ $[C_2H_5(OC_2H_4)_2O]_3Si(CH_2)_3OCH_2CHOHCH_2N^+(C_2H_4OH)_2(C_8H_{17}$ $Cl^-$ $[C_8H_{17}(OC_2H_4)O]_3SiCH_2OCH_2CHOHCH_2N^+(O)^-(C_4H_9)C_6H_5$ $[CH_3CO(OC_2H_4)_6O]_3Si(CH_2)_2OCH_2CHOHCH_2N^+[(C_2H_4O)_{10}H]_2CH_3$ $Cl^-$ $[H(OC_3H_6)_8O]_2C_{16}H_{33}SiCH_2OCH_2CHOHCH_2N^+[(C_2H_4O)_8C_4H_9]_{(CH3)_2}$ $Br^-$ $[C_2H_5(OC_2H_4)_4O]_3SiCH_2OCH_2CHOHCH_2N^+[(C_2H_4O)_2COCH_3]_2CH_3$ $Br^-$ $[C_{18}H_{39}(OC_2H_4)_3O]_3SiCH_2OCH_2CHOHCH_2P^+(C_2H_5)_2C_{14}H_{29}$ $Cl^-$ $[H(OC_3H_6)_8)$ $_3Si(CH_2)_3OCH_2CHOHCH_2P^+(C_3H_6COOH)_2C_6H_{13}$ $Cl^-$ $[C_8H_{17}(OC_2H_4)_2O]_2CH_3SiCH_2OCH_2CHOHCH_2P^+(C_2H_4OH)(CH_3)C_8H_{17}$ $Cl^-$ $[CH_3(OC_3H_6)O]_3Si(Ch_2)_3OCH_2CHOHCH_2P^+(O)^-(CH_3)C_{10}H_{21}$ $[C_2H_5(OH_4C_2)_{12}O]_3Si(CH_2)_2OCH_2CHOHCH_2P^+[(C_2H_4O)_2H]_2C_6H_4CH_3$ $Br^-$ $[CH_3CO(OC_2H_4)_8O]_3SiCH_2OCH_2CHOHCH_2P^+[(C_3H_6O)_8C_2H_5](C_4H_9)_2$ $Cl^-$ $[H(OC_2H)_4O]_3SiCH_2OCH_2CHOHCH_2S^+(CH_3)C_{18}H_{37}$ $Cl^-$ $[C_{16}H_{33}(OC_2H_4)_6O]_2C_{12}H_{25}SiCH_2OCH_2CHOHCH_2S^+(C_3H_6COOH)C_{10}H_{21}$ $Cl^-$ $[CH_3(OC_4H_8)_4O]_3SiCH_2OCH_2CHOHCH_2S^+(C_4H_8OH)C_8H_{17}$ $Br^-$ $[H(OC_2H_4)_{14}O]_3Si(CH)_2OCH_2CHOHCH_2S^{+-}(O)^-C_{12}H_{14}C_6H_5$ $[C_9H_{19}(OC_2H_4)O]_3SiCH_2OCH_2CHOHCH_2S^+[(C_2H_4O)_6H]C_6H_{13}$ $Cl^-$ $[C_2H_5CO(OC_2H_4)_2O]_3SiCH_2OCH_2CHOHCH_2S^+[(C_4H_8O)_{12}CH_3]C_8H_{17}$ $Cl^-$

Commonly assigned copending patent application "Organosilane Compounds" by Heckert and Watt, U.S. Ser. No. 570,538, filed Apr. 22, 1975, discloses the preparation of these compounds. (The disclosure of this application is herein incorporated by reference.)

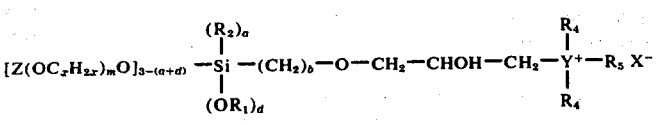

XII.

wherein Z is hydrogen, a $C_{1-18}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided $a+d$ does not exceed 2, $b$ is 1–3, $R_4$ is a $C_{1-12}$ alkyl, aryl or arylalkyl group, a carboxy-substituted $C_{1-4}$ alkyl group, $$(C_xH_{2x}O)_mZ$$

where $x$, $m$ and Z are as defined above, or oxygen provided only one $R_4$ is oxygen, $R_5$ is a $C_{1-22}$ alkyl, aryl or arylalkyl group, X is halide, and Y is N, S or P.

These compounds are prepared in a manner similar to that described for the compounds of Example XI except that only a part of the $R_1OH$ is replaced by $$HO(C_xH_{2x}O)_mZ.$$

The following compounds are examples of compounds having the Formula XII.

$[H(OC_2H_4)_{12}O](CH_3O)_2SiCH_2OCH_2CHOHCH_2N^+(CH_3)_2C_{18}H_{37}$ $Cl^-$ $[H(OC_3H_6O)_3O](C_2H_5O)(CH_3)Si(CH_2)_2OCH_2CHOHCH_2N^+(CH_2COOH)(C_4H_9)_2$ $Cl^-$ $[C_{12}H_{25}(OC_2H_4)_9O](C_2H_5O)_2SiCH_2OCH_2CHOHCH_2N^+(C_4H_8OH)_2CH_3$ $Cl^-$ $[CH_3(OC_4H_8)_2O]_2(C_4H_9O)Si(CH_2)_3OCH_2CHOHCH_2N^+(O)^-(CH_3)$ $C_{16}H_{33}$ $[CH_3CO(OC_2H_4)_6O]_2(CH_3O)SiCH_2OCH_2CHOHCH_2N^+[(C_2H_4O)_8H]_2CH_3$ $Br^-$ $[H(OC_2H_4)_{18}O](C_2H_5O)(C_{16}H_{33})SiCH_2OCH_2CHOHCH_2N^+[(C_2H_4O)C_{12}H_{25}](CH_3)_2$ $Cl^-$ $[H(OC_2H_4)_8O](C_2H_5O)_2SiCH_2OCH_2CHOHCH_2P^+(CH_3)_2C_6H_5$ $Cl^-$ $[CH_3(OC_2H_4)_6O](C_{12}H_{25})(CH_3O)SiCH_2OCH_2CHOHCH_2P^+[(C_2H_4O)_6OCH_3]_2(CH_3)$ $[CH_3CO(OC_3H_6)_4O]_2(CH_3O)Si(CH_2)_3OCH_2CHOHCH_2P^+(C_4H_8OH)_2CH_3$ $Cl^-$ $[H(OC_4H_8)_2O](CH_3O)(CH_3)SiCH_2OCH_2CHOHCH_2S^+[(C_2H_4O)_3H]C_2H_5$ $Cl^-$ $[C_{12}H_{25}(OC_2H_4O](C_4H_9O)_2Si(CH_2)_2OCH_2CHOHCH_2S^+(C_3H_6COOH)CH_3$ $Br^-$ $[C_2H_5CO(OC_2H_4)_{10}O]_2(C_2H_5O)SiCH_2OCH_2CHOHCH_2S^+(O)^-C_{12}H_{25}$

Commonly assigned copending patent application "Organosilane Compounds" by Heckert and Watt, U.S. Ser. No. 570,531, filed Apr. 22, 1975, discloses the preparation of these compounds. (The disclosure of this application is herein incorporated by reference.)

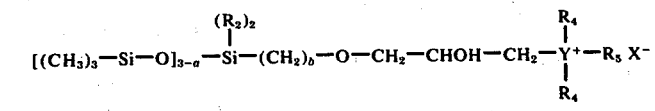

XIII.

wherein $a$ is 0–2, $R_2$ is a $C_{1-18}$ alkyl group, $b$ is 1–3, $R_4$ is a $C_{1-12}$ alkyl, aryl or arylalkyl group, a carboxy-substituted $C_{1-4}$ group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

Tris(trimethylsiloxy)silanes, which are prepared from commercially available trimethylhalosilanes and trihalosilanes, are used as the starting reactants when *a* is 0. Subsequent reaction steps and conditions as discussed with the preparation of compounds of Formula X are used to produce the desired compound of Formula XIII.

When *a* is 1 or 2, a compound of Formula X is reacted with trimethylchlorosilane at an elevated temperature, e.g. 50° C. to 200° C. to obtain the desired organosilane.

The following compounds are illustrative of the compounds of Formula XIII.

$[(CH_3)_3SiO]_3SiCH_2OCH_2CHOHCH_2N^+(CH_3)_2C_{10}H_{21}$ $Cl^-$ $[(CH_3)_3SiO]_2CH_3SiCH_2OCH_2CHOHCH_2N^+(C_2H_4COOH)(C_4H_9)_2$ $Cl^-$ $[(CH_3)_3SiO]_3Si(CH_2)_3OCH_2CHOHCH_2N^+(C_2H_4OH)_2C_8H_{17}$ $Cl^-$ $[(CH_3)_3SiO]_3SiCH_2OCH_2CHOHCH_2N^+(O)^-(C_2H_5)C_6H_4C_2H_5$ $[(CH_3)_3SiO]_3Si(CH_2)_2OCH_2CHOHCH_2N^+[(C_2H_4O)_{10}H]_2CH_3$ $Cl^-$ $[(CH_3)_3SiO]_2C_2H_5SiCH_2OCH_2CHOHCH_2N^+[(C_2H_4O)_8C_4H_9)(CH_3)_2$ $Br^-$ $[(CH_3)_3SiO]_3SiCH_2OCH_2CHOHCH_2N^+[(C_3H_6O)_2COCH_3]_2CH_3$ $Br^-$ $[(CH_3)_3SiO]_3SiCH_2OCH_2CHOHCH_2P^+(C_2H_5)_2C_{14}H_{29}$ $Cl^-$ $[(CH_3)_3SiO]_3Si(CH_2)_2OCH_2CHOHCH_2P^+(C_3H_6COOH)_2C_6H_5$ $Cl^-$ $[(CH_3)_3SiO]_2CH_3SiCH_2OCH_2CHOHCH_2P^+(C_2H_4OH)(CH_3)C_8H_{17}$ $Cl^-$ $[(CH_3)_3SiO]_3Si(CH_2)_3OCH_2CHOHCH_2P^+(O)^-(CH_3)C_{10}H_{21}$ $[(CH_3)_5SiO]_3Si(CH_2)_2OCH_2CHOHCH_2P^+[(C_2H_4O)_2H]_2C_{10}H_{21}$ $Br^-$ $[(CH_3)_3SiO]_3SiCH_2OCH_2CHOHCH_2P^+[(C_3H_6O)_8C_2H_5](C_4H_9)_2$ $Cl^-$ $[(CH_3)_3SiO]_3SiCH_2OCH_2CHOHCH_2S^+(CH_3)C_{18}H_{37}$ $Cl^-$ $[(CH_3)_3SiO]_2C_{12}H_{25}SICH_2OCH_2CHOHCH_2S^+(C_3H_6COOH)C_{10}H_{21}$ $Cl^-$ $[(CH_3)_3SiO]_3SiCH_2OCH_2CHOHCH_2S^+(C_4H_8OH)C_8H_{17}$ $Br^-$ $[(CH_3)_3SiO]_3Si(CH_2)_2OCH_2CHOHCH_2S^+(O)^-C_{16}H_{33}$ $[(CH_3)_3SiO]_3SiCH_2OCH_2CHOHCH_2S^+[(C_2H_4O)_6H]C_6H_4CH_3$ $Cl^-$ $[(CH_3)_3SiO]_3SiCH_2OCH_2CHOHCH_2S^+[(C_4H_8O)_{12}CH_3]C_8H_{17}$ $Cl^-$

U.S. Pat. NO. 3,389,160 discloses compounds of Formula XIII when $R_4$ is an alkyl, aryl, or arylalkyl group. Commonly assigned patent application, "Organosilane Compounds" by Heckert and Watt, U.S. Ser. No. 570,538, filed Apr. 22, 1975, discloses the preparation of the other compounds. (The disclosure of this application is herein incorporated by reference.)

Siloxane oligomers of the above organosilanes are also useful in the present invention. Such oligomers are formed from the monomers by the controlled addition of from 1 to 100 equivalents of water, preferably in an inert solvent such as alcohol, tetrahydrofuran, etc. As used herein, "oligomers" is used to mean a degree of polymerization of from 2 to 100, preferably 2 to 20. A higher degree of polymerization adversely affects the ability of the compound to bond itself to the hard surface and is for this reason avoided. Examples of siloxane oligomers having varying degrees of polymerization are readily visualized from the above examples of organosilane monomers.

The organosilane is included in the composition of this invention at a level of from 0.1% to 50%, preferably 1% to 10%. A level below 0.1% does not provide a noticeable benefit initially (through a gradual buildup is possible) while levels of organosilane above 50% do not provide an additional soil release benefit and is for this reason avoided.

Water-soluble, organic, nonionic detergents which are used in the compositions of this invention are any of a wide variety of known compounds. U.S. Pat. No. 3,579,454 issued May 18, 1971, to Everett J. Collier, Column 12, line 16 to Col. 13, line 40 (the disclosure of which is herein incorporated by reference) describes suitable nonionic detergents which may be used herein. Preferred are the $C_{10}$ to $C_{16}$ alcohols ethoxylated with from 2 to 10 moles of ethylene oxide. The amount of nonionic detergents included in the composition of this invention ranges from 5% to 98.9%, preferably 10% to 70%.

The monofunctional organic acid is included in the rinse aid composition at a level of from 1% to 40%, preferably 5% to 20%. Such organic acids have from 1 to 6 carbon atoms (inclusive of their substituent groups) in their structure. Examples of suitable organic acids include the following: acetic, formic, propionic, butenoic, pentanoic and caproic acids.

As with any rinse aid composition, the composition of this invention is mixed with water and sprayed onto the cleaned cooking utensils and tableware during the final cycle or stage in an automatic dishwashing machine. As previously mentioned, the rinse aid helps in the water sheeting action of the rinse water and in this manner helps to assure that droplets of water are not left behind. Such droplets invariably contain dissolved substances which, when dried, will leave an unsightly spot on the rinsed cooking utensils or tableware. The application of the rinse aid of the present invention results in the deposition of a thin polymeric layer of the organosilane compound onto the cleaned objects. When the cooking utensils and tableware are subsequently soiled, the soil adheres to such surfaces less tenaciously as a result of the polymeric coating.

It is theorized that the positive atom of the organosilane compound is attracted to the negatively charged sites on the cooking utensils and tableware. The silicon atom in the organosilane compound then forms a bond with the surface of the cooking utensil or tableware. The presence of the positive charge on the organosilane is necessary to allow the bonding to take place within the normal rinse cycle of an automatic dishwashing machine, i.e. within about 2 minutes and under the dilute conditions normally encountered. The alkyl chains attached to the positively charged organosilane provide the soil release benefits of the compound.

However, due to the positively charged nature of the organosilane compound, negatively charged soil particles and anions which can codeposit hardness ions e.g. calcium and magnesium ions are also attracted to the surface of the organ-silane-coated cooking utensils and tableware. The inclusion of the monofunctional organic acid in the rinse aid composition provides an anion which will be attracted to the positively charged organosilane coating thereby minimizing the attraction of the soil particles and anions previously mentioned.

When the cooking utensils and tableware are dried completely, excess organic acid evaporates, leaving behind the organosilane-coated surface. This insures that objectionable filming does not form on the surfaces. Also, the monofunctional organic acid aids in the deposition of the organosilane within the short time period encountered in an automatic dishwashing machine.

In addition to the components described above, the rinse aid compositions of this invention may include as optional ingredients (1) defoaming agents, and (2) sequestering agents which serve to inhibit precipitation of water hardness salts. Suitable defoaming agents include high molecular weight poly(oxyalkylene)glycols and higher aliphatic monohydric alcohols. The sequestering agents which may be either inorganic or organic acid are included at a level up to 30% of the composition, preferably 5% to 10%. Suitable acids include phosphoric, glycolic, tartaric, succinic, citric, lactic, fumaric and glyconic acids. The sequestering agent prevents the formation of spots by keeping hardness ions in solution.

The following examples are illustrative of the compositions of this invention.

EXAMPLE I

Rinse aid compositions having the following compositions are formulated:

| | A. | B. |
|---|---|---|
| Nonionic detergent (50:50 mixture of $C_{14}$ and $C_{15}$ alcohols ethoxylated with 4 moles of ethylene oxide) | 57.0% | 57.0% |
| Organosilane | 5.0% | 5.0% |
| Acetic acid | 0% | 19.0% |
| Citric Acid | 9.5% | 9.5% |
| Water | 28.5% | 9.5% |

The organosilane has the formula

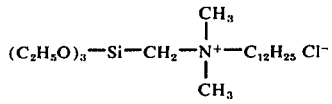

Cooking utensils and tableware which have been washed in an automatic dishwasher are given a final rinse with 10.0 grain water having a temperature of 55° C and containing 0.01% Composition A. In a separate washing and rinsing under identical conditions Composition B is tested. The washed utensils and tableware from each of the runs have a soil release benefit imparted to them as evidenced by the noticeable ease in cleaning in subsequent washings.

However, glassware which is included in the runs, have a better appearance when rinsed with Composition B compared to those rinsed with Composition A. Visual grading for spotting and filming is done on a 0 to 10 scale with 0 representing complete filming and 10 representing a completely filmless and spotless appearance. Average grades for the glassware are 5.3 (spotting) and 7.0 (filming) for those rinsed with Composition A and 6.5 (spotting) and 7.6 (filming) for those rinsed with Composition B.

Substantially the same results are obtained when the organosilane of Composition B is replaced at the same level by organosilanes having the following formulae:

$(C_2H_5O)_3SiCH_2N^+(CH_3)_2C_{12}H_{25}$ $Cl^-$
$(C_2H_5O)_3SiCH_2P^+(CH_3)_2C_{12}H_{25}$ $Cl^-$
$(C_2H_5O)_3Si(CH_2)_2N^+(CH_3)_2C_{12}H_{25}$ $Cl^-$
$(C_2H_5O)_3Si(CH_2)_3N^+(CH_3)_2C_{12}H_{25}$ $Br^-$
$(C_2H_5O)_3SiCH_2N^+(CH_3)_2C_6H_{13}$ $Cl^-$
$(CH_3O)_3SiCH_2N^+(CH_3)_2C_6H_5$ $Cl^-$
$(C_2H_5O)_3SiCH_2N^+(CH_3)_2C_{18}H_{37}$ $Cl^-$
$(C_2H_5O)_3SiCH_2S^+(CH_3)C_{18}H_{37}$ $Cl^-$
$(C_4H_8O)_3SiCH_2N^+(CH_3)_2C_{12}H_{24}C_6H_5$ $Cl^-$
$(CH_3O)_3SiCH_2N^+[(C_3H_6O)_3C_2H_5]_2C_8H_{17}$ $Cl^-$
$(C_2H_5O)_3Si(CH_2)_3N^+(C_2H_5)[(C_4H_9O)_8H]C_4H_9$ $Cl^-$
$(C_2H_5O)_3SiCH_2N^-(C_3H_7COOH)_2C_8H_{17}$ $Cl^-$
$(C_2H_5O)_3SiCH_2N^+[(C_2H_4O)_4COOH_3]_2C_{18}H_{37}$ $Cl^-$
$[(CH_3)_3SiO]_3SiCH_2N^+(CH_3)_2C_{12}H_{25}$ $Br^-$
$(C_2H_5O)_3SiCH(C_{12}H_{25})N^+(C_2H_5)_3$ $Cl^-$
$(C_2H_5O)_3SiCH(C_{12}H_{25})P^+(C_2H_5)_3$ $Cl^-$
$(CH_3O)_2CH_3SiCH(C_{18}H_{37})N^+(CH_3)_3$ $Br^-$
$(CH_3O)_2CH_3SiCH(C_{18}H_{37})S^+(CH_3)_2$ $Br^-$
$(C_2H_5O)_3SiCH_2N^+(O)^-(CH_3)C_{14}H_{29}$
$(C_2H_5O)_3SiCH_2S^+(O)^-C_{14}H_{29}$
$(CH_3O)_3Si(CH_2)_3N^+(CH_3)_2C_6H_4C_3H_7$ $Cl^-$
$(CH_3O)_3SiCH_2N^+(C_2H_4OH)(CH_3)C_{12}H_{25}$ $Cl^-$
$(CH_3O)_3Si(CH_2)_3OCH_2CHOHCH_2N^+(CH_3)_2C_8H_{17}$ $Cl^-$
$(C_2H_5O)_2C_4H_9SiCH_2N^+(CH_3)_2C_{12}H_{25}$ $Cl^-$
$[H(OC_2H_4)_{18}O]]_3SiCH_2N^+(C_2H_5)_2C_{18}H_{37}$ $Cl^-$
$[CH_3(OC_2H_4)_{12}O]_2CH_3SiCH_2N^+(CH_3)_2C_{12}H_{25}$ $Br^-$
$[CH_3CO(OC_2H_4)_4]_3Si(CH_2)_3N^+(CH_3)_2C_{10}H_{21}$ $Cl^-$
$[H(OC_2H_4)_8](CH_3O)_2SiCH_2N^+(CH_3)_2C_{12}H_{25}$ $Cl^-$
$[CH_3(OC_2H_4)_6O]_3SiCH(C_{12}H_{25})N^+(CH_3)_3$ $Br^-$
$[H(OC_2H_4)_2O]_2(CH_3O)SiCH(C_8H_{17})N^+(CH_3)_2C_6H_{13}$ $Cl^-$
$[(CH_3)_3SiO]_3SiCH(C_{16}H_{37})N^+(CH_3)_2C_4H_9$ $Cl^-$
$[H(OC_2H_4)_4O]_3SiCH_2OCH_2CHOHCH_2N^+(CH_3)_2C_{12}H_{25}$ $Cl^-$
$[CH_3(OC_2H_4)_8O]_2(CH_3O)SiCH_2OCH_2CHOHCH_2N^+(C_4H_9)_3$ $Cl^-$
$[(CH_3)_3SiO]_3SiCH_2OCH_2CHOHCH_2N^+(CH_3)_2C_{14}H_{29}$ $Br^-$
$[(CH_3)_3SiO]_3SiCH_2OCH_2CHOHCH_2P^+(CH_3)_2C_{14}H_{29}$ $Br^-$
Siloxane dimer of $(C_2H_5O)_3SiCH_2N^+(CH_3)_2C_{12}H_{25}$ $Cl^-$
Siloxane dimer of $(C_2H_5O)_2(CH_3)SiCH_2N^+(CH_3)_2C_{16}H_{33}$ $Cl^-$
Siloxane trimer of $(CH_3O)_3Si(CH_2)_3P^+(CH_3)_2C_{12}H_{25}$ $Cl^-$
Siloxane dimer of $(CH_3O)_3SiCH_2S^+(CH_3)C_{12}H_{25}$ $Cl^-$ Substitution of the acetic acid in Composition B with formic acid, propionic acid, butenoic acid, pentanoic acid or caproic acid also gives substantially the same results.

Additional examples of the compositions of this invention follow.

EXAMPLE II

| | |
|---|---|
| Tallow alcohol ethoxylated with 9 moles of ethylene oxide | 63.0% |
| $(C_2H_5O)_3Si(CH_2)_3N^+(CH_3)_2C_{12}H_{25}$ $Cl^-$ | 0.5% |
| Acetic acid | 2.0% |
| Water | 34.5% |

EXAMPLE III

| | |
|---|---|
| Poly(oxyalkylene)nonionic detergent (HA430 supplied by Wyandotte Corp.) | 18.0% |
| $(CH_3O)_2C_4H_8Si(CH_2)_2S^+CH_3C_{12}H_{25}$ $Cl^-$ | 15.0% |
| Acetic acid | 40.0% |
| Ammonium hydroxide | 15.0% |
| Water | 12.0% |

EXAMPLE IV

| | |
|---|---|
| Nonylphenol ethoxylated with 6 moles of ethylene oxide | 40.0% |
| $(CH_3O)_3SiCH_2P^+(CH_3)_2C_6H_{13}$ $Br^-$ | 3.0% |
| Formic acid | 10.0% |
| Water | 47.0% |

We claim:

1. A rinse aid composition capable of imparting soil release properties to cooking utensils and tableware washed therewith consisting essentially of:

a. from 0.1% to 50% of an organosilane having the formula:

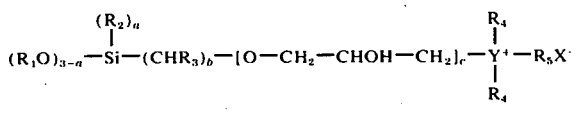

or is a siloxane oligomer thereof wherein $R_1$ is an alkyl group containing 1 to 4 carbon atoms, $(CH_3)_3$ Si or $Z(OCH_xH_{2x})_m$ where $x$ is 2 to 4, $m$ is 1 to 20, and Z is hydrogen, an alkyl group containing 1 to 18 carbons or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$, $m$ and Z are as defined above, or oxygen provided only one $R_4$ is oxygen and further provided that there is no $X^-$ when $R_4$ is oxygen; $R_5$ is an alkyl, aryl, or arylalkyl group containing 1 to 22 carbon atoms; X is halide; and Y is nitrogen, sulfur or phosphorus;

b. from 5% to 98.9% of a water-soluble organic nonionic detergent; and c. from 1% to 40% of a monofunctional organic carboxylic acid containing 1 to 6 carbon atoms.

2. The composition of claim 1 wherein the organosilane has the formula

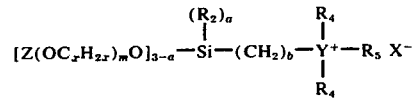

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$, $m$ and Z are as defined above, or oxygen provided only one $R_4$ is oxygen and further provided than when $R_4$ is oxygen there is no $X^-$; $R_5$ is an alkyl, aryl or arylalkyl group containing 1 to 22 carbon atoms; X is halide; and Y is nitrogen, sulfur or phosphorus.

3. The composition of claim 1 wherein the organosilane has the formula

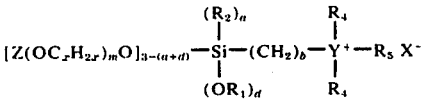

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms, $a$ is 0 or 1; $d$ is 1 or 2 provided $a+d$ does not exceed 2; $b$ is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

4. The composition of claim 1 wherein the organosilane has the formula

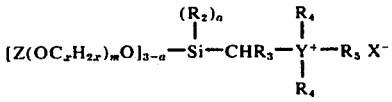

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

5. The compositions of claim 1 wherein the organosilane has the formula

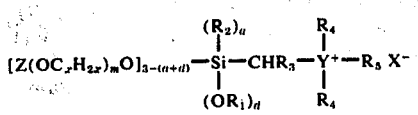

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $R_3$ is an alkyl group containing 1 to 12 carbon atoms; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

6. The composition of claim 1 wherein the organosilane has the formula

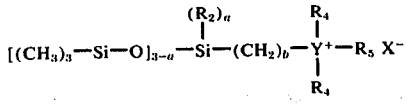

or is a siloxane oligomer thereof wherein $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

7. The composition of claim 1 wherein the organosilane has the formula

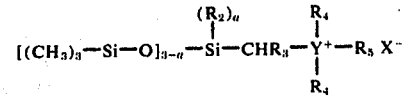

or is a siloxane oligomer thereof wherein $R_2$ is an alkyl group containing 1 to 18 carbon atoms; $a$ is 0 to 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

8. The composition of claim 1 wherein the organosilane has the formula

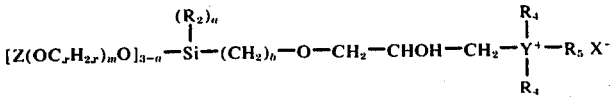

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

9. The composition of claim 1 wherein the organosilane has the formula

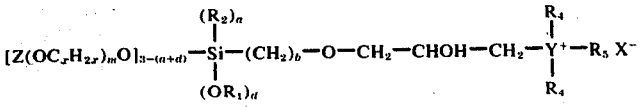

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided a+d does not exceed 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

10. The composition of claim 1 wherein the organosilane has the formula

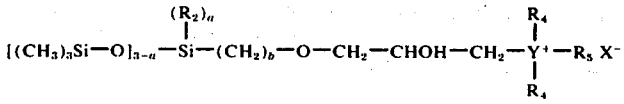

or is a siloxane oligomer thereof wherein $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

11. The composition of claim 1 in which said organosilane has the formula

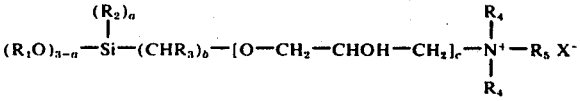

or is a siloxane oligomer thereof wherein $R_1$ is an alkyl group containing 1 to 4 carbon atoms, $(CH_3)_3Si$ or $Z(OC_xH_{2x})_m$ where $x$ is 2 to 4, $m$ is 1 to 20, and Z is hydrogen, an alkyl group containing 1 to 18 carbons or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 12 carbon atoms; and X is halide.

12. The composition of claim 1 wherein the organosilane has the formula

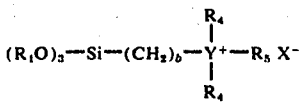

or is a siloxane oligomer thereof wherein $R_1$ is an alkyl group containing 1 to 4 carbon atoms; $b$ 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 4 to 22 carbon atoms; X is a halide; and Y is nitrogen, sulfur or phosphorus.

13. The composition of claim 1 wherein the organosilane has the formula

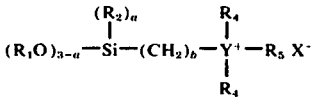

or is a siloxane oligomer thereof wherein $R_1$ is an alkyl group containing 1 to 4 carbon atoms; $R_2$ is an alkyl group containing 1 to 18 carbon atoms; $a$ is 1 or 2; $b$ is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is a halide; and Y is nitrogen, sulfur or phosphorus.

14. The composition of claim 1 wherein the organosilane has the formula

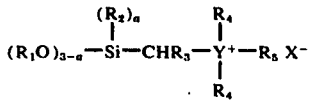

or is a siloxane oligomer thereof wherein $R_1$ is an alkyl group containing 1 to 4 carbon atoms; $R_2$ is an alkyl group containing 1 to 18 carbon atoms; $a$ is 0 to 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is a halide; and Y is nitrogen, sulfur or phosphorus.

15. The composition of claim 1 wherein the organosilane has the formula

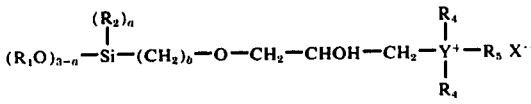

or is a siloxane oligomer thereof wherein $R_1$ is an alkyl group containing 1 to 4 carbon atoms; $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is a halide; and Y is nitrogen, sulfur or phosphorus.

16. The rinse aid composition of claim 1 wherein the organosilane has the formula

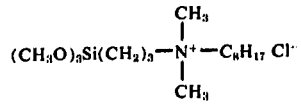

17. The composition of claim 1 wherein the monofunctional organic acid is acetic acid, formic acid, propionic acid, butenoic acid, pentanoic acid, caproic acid or mixture thereof.

18. The composition of claim 17 wherein the organic acid is acetic acid.

19. The composition of claim 17 additionally containing up to 30% of a sequestering agent.

20. The composition of claim 17 consisting essentially of a. from 1% to 10% of the organosilane;

b. from 10% to 70% of the water-soluble nonionic detergent; and c. from 5% to 20% of the monofunctional organic acid.

21. The composition of claim 19 wherein the sequestering agent is present at a level of 5% to 10%.

22. The composition of claim 21 wherein the sequestering agent is citric acid.

23. The composition of claim 20 wherein the organic acid is acetic acid.

* * * * *

UNITED STATES PATENT OFFICE
CERTIFICATE OF CORRECTION

PATENT NO. : 4,005,024

DATED : January 25, 1977

INVENTOR(S) : Pedro A. Rodriguez; David C. Heckert; David M. Watt, Jr.

It is certified that error appears in the above-identified patent and that said Letters Patent are hereby corrected as shown below:

Column 7, line 33, "$(R_1O_3SiCHR_3$" should be -- $(R_1O)_3SiCHR_3$ --.

Column 7, line 33, "$(R_4)_1$ or 2 $YR_5$" should be -- $(R_4)_1$ or $_2YR_5$ --.

Column 14, line 31, "$[(CH_3)_3SiO]_2CH_3SiCH(C_2H_5)N^-(C_2H_4OH)_2C_6H_4CH_3$ $Cl^-$" should be $[(CH_3)_3SiO]_2CH_3SiCH(C_2H_5)N^+(C_2H_4OH)_2C_6H_4CH_3$ $Cl^-$ Column 14, line 52, "$[(CH_2)_3SiO]_3SiCH(CH_3)P^+[(C_2H_4O)C_8H_{17}[_2C_6H_4C_2H_5$ $Cl^-$" should be -- $[(CH_2)_3SiO]_3SiCH(CH_3)P^+[(C_2H_4O)C_8H_{17}]$ $C_6H_4C_2H_5$ $Cl^-$ --.

Column 14, line 57, "$[(CH_3)_3SiO]_3SiCH\ 14H_{29})S^+(C_4H_8OH)CH_3$ $Cl^-$" should be -- $[(CH_3)_3SiO]_3SiCH(C_{14}H_{29})S^+(C_4H_8OH)CH_3$ $Cl^-$ --.

Column 17, line 21, "$H_4O)_8C_4H_{9(CH3)2}$ $Br^-$" should be -- $H_4O)_8$ $C_4H_9(CH_3)_2$ $Br^-$ --.

Column 17, line 26, "$[H(OC_3H_6)_8)$" should be -- $[H(OC_3H_6)_8]$ --.

Column 17, line 31, "$[CH_3(OC_3H_6)O]_3Si(Ch_2)_3OCH_2CHOHCH_2P$" should be -- $[CH_3(OC_3H_6)O]_3$ $Si(CH_2)_3OCH_2CHOHCH_2P$ --.

Column 17, line 57, "570,538" should be -- 570,531 --.

Column 18, line 33, "$CHOHCH_2P^+[(C_2H_4O)_6OCH_3]_2(CH_3)$" should be -- $CHOHCH_2P^+[(C_2H_4O)_6OCH_3]_2(CH_3)$ $Cl^-$ --.

UNITED STATES PATENT OFFICE
CERTIFICATE OF CORRECTION

PATENT NO. : 4,005,024

DATED : January 25, 1977

INVENTOR(S) : Pedro A. Rodriguez, Jr.; David C. Heckert; David M. Watt

It is certified that error appears in the above-identified patent and that said Letters Patent are hereby corrected as shown below:

Column 22, line 16, "$(C_2H_5O)_3SiCH_2N^-(C_3H_7COOH)_2C_8H_{17}$ $Cl^-$" should be -- $(C_2H_5O)_3SiCH_2N^+(C_3H_7COOH)_2C_8H_{17}$ $Cl^-$ --.

Signed and Sealed this

Twelfth Day of April 1977

[SEAL]

*Attest:*

RUTH C. MASON
*Attesting Officer*

C. MARSHALL DANN
*Commissioner of Patents and Trademarks*